United States Patent [19]

Shimizu et al.

[11] 4,298,644

[45] Nov. 3, 1981

[54] EXTREMELY FINE ACRYLIC POLYMER FIBER PILE FABRIC AND PROCESS FOR PRODUCING THE SAME

[75] Inventors: Kunitoshi Shimizu; Masakazu Takamura, both of Fuji; Toshio Iwasa, Kawasaki, all of Japan

[73] Assignee: Asahi Kasei Kogyo Kabushiki Kaisha, Osaka, Japan

[21] Appl. No.: 127,606

[22] Filed: Mar. 6, 1980

Related U.S. Application Data

[63] Continuation-in-part of Ser. No. 925,247, Jul. 17, 1978, abandoned.

[30] Foreign Application Priority Data

| | | | |
|---|---|---|---|
| Jul. 25, 1977 | [JP] | Japan | 52-88330 |
| Aug. 23, 1977 | [JP] | Japan | 52-100133 |
| Aug. 23, 1977 | [JP] | Japan | 52-100134 |
| Aug. 23, 1977 | [JP] | Japan | 52-100135 |

[51] Int. Cl.[3] ..... B32B 33/00; D06C 11/00

[52] U.S. Cl. ..... 428/91; 26/29 R; 28/162; 428/92; 428/97

[58] Field of Search ..... 428/91, 92, 97; 26/29 R, 29 P; 28/162

[56] References Cited

U.S. PATENT DOCUMENTS

| | | | |
|---|---|---|---|
| 3,684,284 | 8/1972 | Tranfield | 428/91 |
| 3,865,678 | 2/1975 | Okamoto | 428/91 |
| 4,103,054 | 7/1978 | Okamoto | 428/91 |
| 4,109,038 | 8/1978 | Hayashi | 428/91 |

*Primary Examiner*—Marion McCamish

*Attorney, Agent, or Firm*—Sprung, Felfe, Horn, Lynch & Kramer

[57] ABSTRACT

An extremely fine acrylic polymer fiber pile fabric, which comprises a substratum fabric impregnated with an elastic polymer and having at least one pile layer formed by raising at least one surface of said fabric, is characterized in that said piles consist essentially of extremely fine independent acrylic polymer fibers, each of which has a denier of 0.8 or less and is provided with a number of amorphous scale-shaped protuberances formed on the peripheral surface thereof, and which has been produced by a wet spinning method from an acrylic polymer containing at least 80% by weight of acrylonitrile.

37 Claims, 2 Drawing Figures

(X8000)

(x8000)

(x8000)

EXTREMELY FINE ACRYLIC POLYMER FIBER PILE FABRIC AND PROCESS FOR PRODUCING THE SAME

The present application is a continuation-in-part of U.S. Pat. Application Ser. No. 925,247, filed on July 17, 1978, now abandoned.

FIELD OF THE INVENTION

The present invention relates to an extremely fine acrylic polymer fiber pile fabric and a process for producing the same. More particularly, the present invention relates to an extremely fine acrylic polymer fiber pile fabric having a natural suede-like feel and being provided with a dense pile layer consisting essentially of extremely fine acrylic polymer fibers, and a process for producing the same.

BACKGROUND OF THE INVENTION

Various pile fabrics in which the piles are made of extremely fine synthetic polymer fibers other than the acrylic polymer fibers are known. However, these types of conventional pile fabrics have disadvantages that the pile fibers are difficult to dye a brilliant, deep color, and it is difficult to make the pile layer completely cover a substratum fabric to the extent that the substratum fabric can not be seen through the pile layer. That is, in the conventional synthetic fiber pile fabrics, the pile fibers are made of a polyester or polyamide, which are difficult to dye a brilliant, deep color, and the pile fibers in the pile layer have a relatively low density, and therefore, the pile layer has a relatively light color. For the above-mentioned reasons, the drawbacks of the conventional synthetic fiber pile fabrics can not be eliminated by any improvements in the dyeing processes for the pile fibers.

The disadvantage that the substratum fabric is seen through the pile layer is a serious drawback of the conventional synthetic fiber pile fabrics, for example, suede-like synthetic leathers. In order to eliminate this disadvantage, attempts have been made to increase the degree of raising applied to the substratum fabric, so as to increase the density of the piles in the pile layer, or to cover the substratum with a resin layer applied thereto. However, the increase in the degree of raising causes the strength of the substratum fabric to be remarkably reduced, and such a reduction in strength results in a decrease in the commercial value of the resultant pile fabric.

Furthermore, in order to completely cover the substratum fabric, it is necessary to apply a large amount of the resin to the pile fabric. The large amount of resin applied to the pile fabric causes the pile fibers to be embedded in the resin layer so as to form a smooth resin surface on the fabric. The resultant fabric has a very poor draping property due to the high stiffness of the resin layer.

There are no synthetic fiber pile fabrics without the disadvantages mentioned above on the commercial market. Therefore, the commercial synthetic fiber pile fabrics in which the piles are made of a synthetic polymer other than the acrylic polymer, are quite different in appearance and feel from natural suede leather.

In order to eliminate the above-mentioned disadvantages, attempts have been made to use acrylic polymer fibers for forming the piles. However, the resultant acrylic polymer fiber pile fabric was found to be unsatisfactory due to an improper stiffness and coarse feel of the acrylic polymer fibers. Accordingly, it is desired that special acrylic polymer fibers or filaments having a proper softness or stiffness and no coarse feel are provided.

Generally, in the process for producing the artificial leather, a solution of an elastic polymer, for example, polyurethane, in a hydrophilic organic solvent, for example, N,N-dimethylformamide, is applied to a substratum fabric, and the solution impregnated in the substratum fabric is coagulated with a coagulating liquid, for example, water. However, it was found that when the substratum fabric contains acrylic polymer fibers, the solvent for the elastic polymer also dissolves the acrylic polymer fibers. Accordingly, it is necessary to provide a new method for applying the elastic polymer to the substratum fabric containing the acrylic polymer fibers or filaments.

SUMMARY OF THE INVENTION

An object of the present invention is to provide an extremely fine acrylic polymer fiber pile fabric having a natural suede-like configuration and feel, and a process for producing the same.

Another object of the present invention is to provide an extremely fine acrylic polymer fiber pile fabric which is capable of being colored a brilliant, deep color, and a process for producing the same.

A further object of the present invention is to provide an extremely fine acrylic polymer fiber pile fabric at least one surface of which is covered with an extremely fine acrylic polymer fiber pile layer having such a high density that the structure of the substratum fabric can not be seen through the pile layer.

The above-mentioned objects can be realized with the extremely fine acrylic polymer fiber pile fabric of the present invention, which comprises a substratum fabric impregnated with an elastic polymer and having at least one pile layer formed on at least one surface of the fabric, and which is characterized in that said piles consist essentially of extremely fine acrylic polymer fibers, each of which has a denier of 0.8 or less and is provided with a number of amorphous scale-shaped protuberances formed on the peripheral surface thereof, and which has been produced by a wet spinning method from an acrylic polymer containing at least 80% by weight of acrylonitrile.

In the pile fabric of the present invention, it is important that the acrylic polymer pile fiber have a denier of 0.8 or less, preferably, 0.4 or less, more preferably, 0.2 or less. It was discovered that, when the denier is 0.8 or less, the extremely fine acrylic polymer fiber has a proper softness and smooth feel. Therefore, the pile fabric of the present invention has a very poor touch.

In the pile fabric of the present invention, it is also important that the acrylic polymer pile fiber be provided with a number of amorphous scale-shaped protuberances formed on the peripheral surface thereof. The scale-shaped protuberances are very effective for causing the resultant pile fabric to exhibit a very natural suede-like touch.

The pile fabric of the present invention can be produced by the process of the present invention, which comprises the steps of:

impregnating a substratum fabric containing extremely fine acrylic polymer fibers or filaments, each of which has a denier of 0.8 or less and is provided with a number of amorphous scale-shaped protuberances formed on the peripheral surface thereof, and which has been produced by a wet spinning method from an acrylic polymer containing at least 80% by weight of acrylonitrile, with a solution of the elastic polymer in a solvent mixture which is capable of dissolving said elastic polymer but not dissolving the acrylic polymer fibers or filaments;

immersing the impregnated fabric into a coagulating liquid which is not capable of dissolving both the elastic polymer and the acrylic polymer fibers or filaments, to cause the elastic polymer to be coagulated in the substratum fabric, which solvent mixture consisting of from 50 to 90% by weight of an organic solvent capable of dissolving the elastic polymer and from 10 to 50% by weight of an organic liquid which is compatible with both the organic solvent and the coagulating liquid but not capable of dissolving the acrylic polymer fibers or filaments, and;

raising, during at least one stage selected from stages occurring before the impregnating step and after the immersing step, at least one surface of the substratum fabric to form a pile layer thereon.

The pile fabric of the present invention can be produced by another process of the present invention, which comprises the steps of:

impregnating a substratum fabric containing extremely fine acrylic polymer fibers or filaments, each of which has a denier of 0.8 or less and is provided with a number of amorphous scale-shaped protuberances formed on the peripheral surface thereof, and which has been produced by a wet spinning method from a acrylic polymer containing at least 80% by weight of acrylonitrile, with an aqueous emulsion of an elastic polymer or its prepolyner;

heat-treating the impregnated fabric at a temperature of from 50 to 180° C in a gas atmosphere to cause the elastic polymer to be deposited in the substratum fabric, and;

raising, during at least one stage selected from stages occurring before said impregnating step and said heat-treating step, at least one surface of the substratum fabric to form a pile layer thereon.

Also, the pile fabric of the present invention can be produced by another process of the present invention which comprises the steps of:

first impregnating a substratum fabric containing extremely fine acrylic polymer fibers or filaments, each of which has a denier of 0.8 or less and is provided with a number of amorphous scale-shaped protuberances formed on the peripheral surface thereof and which has been produced by a wet spinning method from an acrylic polymer containing at least 80% by weight of acrylonitrile, with an organic liquid which is compatible with an organic solvent capable of dissolving an elastic polymer but not capable of dissolving the extremely fine acrylic polymer fibers or filaments;

second, impregnating the first impregnated fabric with a solution of the elastic polymer in the organic solvent;

immersing the second impregnated fabric into a liquid which is not capable of dissolving both the elastic polymer and the extremely fine acrylic polymer fibers or filaments to cause the elastic polymer to be coagulated in the substratum fabric, and;

raising, during at least one stage selected from stages occurring before said first impregnating step and after said immersing step, at least one surface of the substratum fabric to form a pile layer thereon.

DESCRIPTION OF THE PREFERRED EMBODIMENTS OF THE INVENTION

Figure 1:
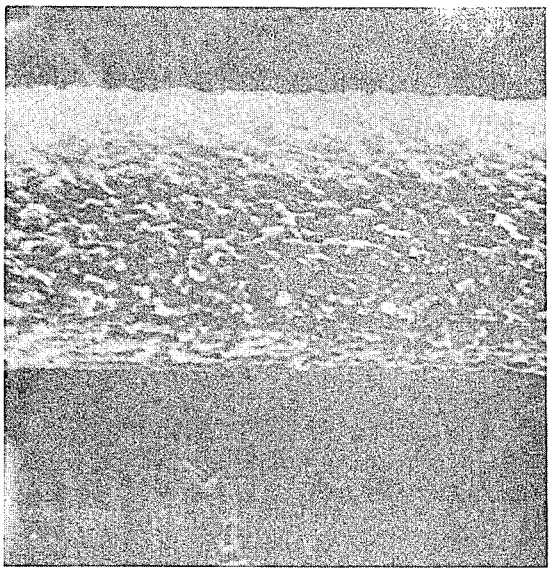
FIG. 1 is a microscopic photograph of an extremely fine acrylic polymer fiber having numerous scale-shaped protuberances formed on the periphery of the fiber.

The pile fabric of the present invention is characterized in that the piles formed on the substratum fabric, consist essentially of extremely fine fibers, each of which has a denier of 0.8 or less and is provided with a number of amorphous scale-shaped protuberances formed on the peripheral surface thereof, and which has been produced by a wet spinning method from an acrylic polymer containing at least 80% by weight of acrylonitrile. That is, the acrylic polymer may be selected from acrylonitrile homopolymer or copolymers of at least 80% by weight of acrylonitrile and the balance of at least one comonomer selected from the group consisting of acrylic acid and its esters, for example, methyl acrylate, ethyl acrylate, propyl acrylate and butyl acrylate, methacrylic acid and its esters, for example, methyl methacrylate, ethyl methacrylate, propyl methacrylate and butyl methacrylate; $\alpha$-chloroacrylic acid and its esters, for example, methyl $\alpha$-chloroacrylate and ehtyl $\alpha$-chloroacrylate; acrylamide and its derivatives, for example, N-methyl acrylamide, N,N-dimethyl acrylamide and N-methylol acrylamide, met hacrylamide and its derivatives, for example, N-methyl methacrylamide, N,N-dimethyl methacrylamide, and N-methylol methacrylamide; vinyl carboxylates, for example, vinyl acetate, vinyl chloroacetate, vinyl propionate and vinyl stearate; vinyl halides, for example, vinyl chloride and vinyl bromide; vinylidene halides, for example, vinylidene chloride and vinylidene bromide; N-substituted alkylamino alkylacrylates, for example, N,N-dimethylamino ethylacrylate; N-substituted alkylamino alkylmethyacrylate, for example, N,N-dimethylamino ethylmethacrylate; vinyl pyridines, for example, 2-vinyl pyridine, 2-methyl-5-vinyl pyridine, unsaturated compounds having a sulfonic acid group, for example, allylsulfonic acid, methallylsulfonic acid and vinyl benzenesulfonic acid and other compounds having a $>C=C<$ group, example, methacrylonitrile and vinyl pyrrollidone.

The extremely fine acrylic polymer fibers or usable for the present invention are provided with a number of amorphous scale-shaped protuberances formed on the peripheral surface thereof. The scale-shaped protuberances are very effective for causing the artificial leather to have a very natural suede-like touch. The protuberances are not limited to a special size and configuration. That is the protuberances may have a circular, triangle, square or rectangular configuration, or any modification of the above-mentioned configurations. However, it is preferable that the protuberances have an average length of 3 microns or less and average height of 0.2 microns or less.

The average length and height of the scale-shaped protuberances are determined by the following measurement.

An extremely fine acrylic polymer fiber is subjected to a vacuum evaporation treatment with gold to form a layer of gold having a thickness of 150 angstroms on the peripheral surface of the fiber. An electron microscopic photograph of a side profile of the fiber is taken by using a scanning type electron microscope at a magnification of 24,000. In a contour of the electron microscopic profile of the fiber, a straight line is drawn between two top points of two neighbouring protuberances, and a distance between the straight line and a bottom point of a cavity formed between the two neighbouring protuberances is measured. This procedure is repeated for 30 pairs of neighbouring protuberances. The average value of the 30 measured distances is referred to as an average height of the protuberances in the fiber.

Also, a distance between two bottom points of two neighbouring cavities is measured. This measurement is repeated for 30 pairs of neighbouring cavities. The average value of the 30 measured distances is referred to as an average length of the protuberances in the fiber.

It is preferable that the extremely fine acrylic polymer fibers or filaments have a porosity of 20% or more determined in terms of amount of water adsorbed by the fibers or filaments. The porosity is determined in accordance with the following formula (1):

$$\text{Porosity (\%)} = \frac{W_0 - W_1}{W_1} \times 100 \qquad (1)$$

wherein $W_0$ represents a weight of a fiber or filament mass which has been immersed in water for one hour at a temperature of 20° C. and centrifugalized at 1500 r.p.m. for ten minutes, and $W_1$ represents a weight of a fiber or filament mass obtained by drying the above-mentioned centrifugalized fiber or filament mass at a temperature of 80° C. for 24 hours.

The above-mentioned extremely fine acrylic polymer fibers or filaments having numerous protuberances can be produced by the special process mentioned hereinafter. Japanese Patent Application Publication (Kokoku) No. 38-5862(1936) discloses a method for producing acrylic polymer fibers or filaments by a wet spinning process in which a spinning solution containing the acrylic polymer dissolved in an aqueous nitric acid solution is extruded into and coagulated in a coagulating bath. In this method, since the aqueous nitric acid solution for dissolving the acrylic polymer has a relatively low concentration, the concentration of the acrylic polymer in spinning solution is also relatively low. Accordingly, a number of streams of the acrylic polymer solution are extruded through spinning holes of a spinneret and solidified in a coagulating bath, the extruded streams of the acrylic polymer solution or the coagulated acrylic polymer filaments frequently adhere to each other. Accordingly, it has been difficult to utilize the above-mentioned prior art method in industry.

In order to eliminate the disadvantages of the prior art, the inventors of the present invention have studied and compared the relationship of the spinning process conditions, for example, composition and concentration of the aqueous nitric acid solution for dissolving the acrylic polymer, composition and concentration of the coagulating bath, coagulating temperature, draft at which the extruded and coagulated acrylic polymer filaments are drafted in the coagulating bath, and concentration of the acrylic polymer in the spinning solution, to the quality of the resultant acrylic polymer fibers or filaments. As a result, surprisingly, it was discovered that, under certain spinning process conditions, the resultant extremely fine acrylic polymer fibers or filaments are provided with numerous amorphous scale-shaped protuberances formed on the peripheral surface thereof and have a proper softness and non-creaky touch, and that such special acrylic polymer fibers or filaments can be produced with high efficiency.

The new process of the inventors comprises:

dissolving a fiber-forming acrylic polymer in an aqueous solution of 60% by weight or more of nitric acid;

extruding the resultant aqueous nitric acid solution of the acrylic polymer through a spinneret having a plurality of spinning holes into a coagulating bath containing an aqueous solution of 42% by weight or more, but less than 44% by weight, of nitric acid to solidify the extruded streams of the solution of the acrylic polymer in the form of a plurality of filaments;

taking up the solidified acrylic polymer filaments at a take-up speed which is the same as or more than the theoretical extruding speed of the acrylic polymer solution, and;

drawing the taken-up acrylic polymer filaments at a predetermined draw ratio, the inside diameters of the spinning holes, the extruding speed of the acrylic polymer solution, the take-up speed and the draw ratio each being fixed at a value which is suitable for obtaining the denier of 0.8 or less of the extremely fine acrylic polymer fiber or filament.

In the above-mentioned new process, the aqueous nitric acid solution for dissolving therein the acrylic polymer to prepare the spinning solution, has a high concentration of nitric acid of 60% by weight or more, preferably, 67 to 90% by weight. Due to this high concentration of nitric acid in the spinning solution, the coagulating solution is caused to have a relatively low concentration of nitric acid of 42% or more, but less than 44% by weight, preferably, from 42 to 43.5% by weight. By adjusting the concentrations of nitric acid in the spinning solution and the coagulating solution to the above-mentioned ranges of values, the spinning operation can be carried out with high efficiency without any difficult, and the resultant extremely fine acrylic polymer fibers or filaments are provided with numerous amorphous scale-shaped protuberances on the peripheral surface thereof. Furthermore, it was discovered that the extremely fine acrylic polymer fibers or filaments have a proper softness and smooth feel. This results of the new process could not be expected from the afore-mentioned prior art.

The reason why a number of amorphous scale-shaped protuberances are formed on the peripheral surface of the acrylic polymer fiber or filament is assumed to be as follows. In the new process, the difference in the concentration of nitric acid between the spinning solution and the coagulating solution is very large and the extruded streams of the spinning solution are very thin. Therefore, when the extruded streams of the spinning solution come into contact with the coagulating solution, firstly, the peripheral surface layers of the extruded spinning solution streams are very rapidly coagulated so as to form very stiff, thin skin layers, and; secondly, the above-mentioned surface-coagulated streams of the spinning solution are drafted in the coagulating bath while being additionally coagulated. During the process of drafting, the stiff, thin skin layers are randomly cracked. The randomly cracked skin layers The heating time for the woven substratum fabric can be optionally determined in consideration of the type of the heating medium, the heating temperature, and the difference in shrinkage between the wefts and the warps in the substratum fabric at the heating temperature, so that the surface layer portion of the shrunk substratum fabric is formed mainly by the wefts.

In the pile fabric, the substratum pile fabric is impregnated with an elastic polymer. The elastic polymer may be selected from the group consisting of polyurethanes, polyamides, polyamino acids, polyvinyl chloride, ethylenevinyl acetate copolymers, styrene-butadiene copolymers, butadiene-acrylonitrile copolymers, polymeric materials consiting essentially of at least one acrylic ester, and mixtures of two or more of the above-mentioned polymers. Most preferable elastic polymer is a polyurethane. The polyurethane may be selected from the group consisting of polyether type polyurethanes, polyester type polyurethanes, polyether-polyester block copolymer type polyurethanes and mixtures of two or more of the above-mentioned polymers.

In the pile fabric of the present invention, the amount of the elastic polymer to be impregnated in the substratum pile fabric is not limited to a special range of values. However, it is preferable that the above-mentioned amount is in a range of from 1 to 30%, based on the entire weight of the raised, impregnated pile fabric.

In the pile fabric of the present invention, it is preferable that the root protions of the piles be embedded in the impregnated elastic polymer so as to firmly support the piles upright. It is also preferable that the embedded piles be in an amount of 5 to 80%, more preferably, 20 to 60%, based on the total weight of the piles. When the amount of the piles embedded in the elastic polymer is less than 5%, it may be impossible to completely cover the structure of the substratum fabric with the pile layer. Also, when the amount of the piles embedded in the elastic polymer is larger than 80%, the resultant pile fabric will have an undesirable stiffness and will be provided with a non-suede-like smooth surface, because the pile layer is substantially completely embedded in the elastic polymer. Generally, when the pile layer is formed by extremely fine fibers having a denier of 0.8 or less, it is difficult for the pile fibers to be maintained upright, because the pile fibers have a very small apparent Young's modulus. Therefore, the pile fibers tend lie down on the surface of the substratum fabric. Under the above-mentioned condition of the pile fibers, the appearance and feel of the resultant pile fabric are very different from those of natural suede leather.

In the pile fabric of the present invention, it is preferable that the amount of the impregnated elastic polymer be in a range of from 1 to 30% based on the entire weight of the raised, impregnated pile fabric.

In the preparation of the pile fabric of the present invention, at least one surface of the substratum fabric containing the extremely fine acrylic polymer fibers or filaments is raised so as to form the pile layer composed essentially of the extremely fine acrylic polymer fiber piles. The raising operation can be carried out by any conventional raising machines, for example, a German type, French type, British type or Universal type card clothing raising machine and a so-called sander. In the card clothing raising machine, a card clothing in which numerous fine needles stand at a high density on a thin rubber sheet, is wound on a rotatable drum. In the raising operation, the drum is rotated at a high speed in such a manner that the top ends of the needles are brought into contact with the surface of the substratum fabric to be raised so as to convert the extremely fine acrylic polymer fibers located in the surface portion of the substratum fabric into piles.

The sander involves a drum sander in which sand paper having numerous abrasive grains made of garnet or sand is wound on a rotatable drum or a belt sander in which an endless belt consisting of a sand paper is rotated. In both types of sanders, the sand paper is brought into contact with the surface of the substratum fabric to raise the surface.

The card clothing raising machine is suitable to form relatively long piles and the sander is proper to produce relatively short piles. Accordingly, the raising machine suitable for obtaining a nubuck-like pile fabric is the sander rather than the card clothing raising machine. However, the substratum fabric may be raised by concurrently using the sander and the card clothing raising machine. Further, the raised substratum fabric may be subjected to a brushing or shearing process to improve the quality of the raised pile layer.

The raising operation is applied to the substratum fabric during at least one stage selected from stages occurring before the elastic polymer-impregnating step and after the impregnated elastic polymer is fixed in the substratum fabric. The impregnating operation can be carried out as follows. The substratum fabric is impregnated with a solution of the elastic polymer in a solvent mixture which is capable of dissolving the elastic polymer but not dissolving the acrylic polymer fibers or filaments, and; then, the impregnated substratum fabric is immersed into a coagulating liquid which is not capable of dissolving both the elastic polymer and the acrylic polymer fibers or filaments, so as to cause the elastic polymer to be coagulated in the substratum fabric. In this case, the solvent mixture consists of from 50 to 90% by weight of an organic solvent capable of dissolving the elastic polymer and from 10 to 50% by wieght of an organic liquid which is compatible with both the organic solvent and the coagulating liquid but which is not capable of dissolving the acrylic polymer fibers or filaments. If the content of the elastic polymer-soluble organic solvent in the solvent mixture is more than 90% by weight, it will cause the acrylic polymer fibers or filaments in the substratum fabric to be dissolved. This dissolving of the acrylic polymer fibers or filaments results in deformation and modification in quality of the substratum fabric or the resultant impregnated pile fabric. Also, if the content of the elastic polymer-soluble organic solvent is less than 50% by weight, the resultant solvent mixture has a poor capability of dissolving therein the elastic polymer.

The organix solvent capable of dissolving the elastic polymer may be selected from, for example, the group consisting of N,N-dimethylformamide, N,N-dimethylacetamide, N,N-dimethylsulfoxide and mixtures of at least two of the above-mentioned compound. The organic liquid not capable of dissolving the acrylic polymer fibers or filaments may be selected from, for example, the group consisting of acetone, methyl alcohol, ethyl alcohol, methylethylketone, toluene, ethyl acetate, butyl acetate, propyl acetate, isobutyl acetate, cyclohexahone, xylene trichloroethylene, benzene, methylene chloride, tetrachloroethylene, and mixtures of two or more of the above-mentioned compounds. It is preferable that the elastic polymer be contained in an amount of from 1 to 30%, more preferably, from 5 to 10% by weight, in the solvent mixture.

The above-mentioned impregnating and coagulating operations can be carried out at a temperature of from 0° to 55° C., but preferably, from 0° to 30° C.

After the coagulating operation is completed, the impregnated fabric is dried, for example, at a temperature of from 50° to 150° C. The dried fabric may be heat-treated at a temperature of from 70° to 180° C. for from 10 seconds to 30 minutes in the ambient atmosphere or in a inert gas atmosphere, for example, a nitrogen gas atmosphere. This heat-treatment is effective for improving the dimensional stability of the fabric.

The impregnation of the substratum fabric with the elastic polymer can be effected by another process in which the substratum fabric is impregnated with an aqueous emulsion of the elastic polymer or its prepolymer and, then, the impregnated fabric is heat-treated at a temperature of from 50° to 180° C. in a gas atmosphere to cause the elastic polymer to be deposited in the raised fabric. The aqueous emulsion of the elastic polymer or its prepolymer is prepared by emulsifying, by using or not using an emulsifying agent, a solution of the elastic polymer in an organic solvent which is capable of dissolving the elastic polymer, in water or an aqueous solution of an organic substance which is not capable of dissolving both the elastic polymer and the acrylic polymer, for example, methyl alcohol, ethyl alcohol or glycerine. It is preferable that the emulsion particles of the elastic polymer solution be as small as possible. In order to improve the emulsifying property, the matric medium of the emulsion can contain a proper amount of an emulsifying agent or an organic solvent which is capable of dissolving the elastic polymer. The emulsifying agent may be a non-ionic surface active agent. The organic solvent may be, for example, N,N-dimethylformamide. The emulsifying agent may be used in an amount of 5% by weight or less, preferably, 1% by weight or less, and the organic solvent in an amount of 40% by weight or less, preferably, 10% by weight or less.

In the aqueous emulsion, the elastic polymer is preferably contained in an amount of from 1 to 30% by weight, more preferably, from 5 to 10% by weight.

The impregnation of the substratum fabric with the aqueous elastic polymer emulsion can be carried out by immersing the substratum fabric into the emulsion and, then, squeezing the immersed fabric with a pair of nip rollers or centrifuge, so as to maintain a predetermined amount of the emulsion in the fabric, or by coating or spraying a predetermined amount of the emulsion onto the substratum fabric. The amount of the emulsion to be impregnated in the substratum fabric is preferably in an range of from 1 to 200% based on the weight of the substratum fabric. The impregnating operation can be carried out at any temperature unless the emulsion and the substratum fabric is degraded at the temperature. The preferable impregnating temperature is in a range of from 0° to 55° C., more preferably, from 15° to 30° C.

The impregnated fabric is heat-treated at a temperature of from 50° to 180° C. in a gas atmosphere for a period of, for example, 5 minutes to 60 minutes, so as to cause the impregnated fabric to be dried and the elastic polymer to be deposited in the fabric. This heat-treatment is carried out until the water content in the fabric becomes 10% by weight or less. The heat-treatment may contain the steps of drying the impregnated fabric at a temperature of from 50° to 150° C. and, then, curing the dried fabric at a temperature of from 70° to 180° C. for from 10 seconds to 30 minutes. This curing is effective for firmly fixing the elastic polymer to the substratum fabric and for improving the dimensional stability of the impregnated fabric. The elastic polymer may be applied in the form of its prepolymer into the substratum fabric, and then, the prepolymer may be converted into the elastic polymer which is thermally and chemically stable at an elevated temperature. The elastic prepolymer may be a compound having a reactive isocyanate group located at an end of the molecule of the compound, or a compound having a blocked isocyanate group which is located at an end of the molecule of the compound and which is capable of thermally or chemically decomposing to form a reactive isocyanate group. That is, the elastic prepolymer may be a compound of the following formula:

$$\mathrm{OCN{-}R{-}NH\overset{\overset{\displaystyle O}{\|}}{C}O{-}A{-}O\overset{\overset{\displaystyle O}{\|}}{C}NH{-}RNCO}$$

which is prepared by reacting an isocyanate compound of the formula, OCN—R—NCO, with a polyester or polyether of the formula, HO—A—OH, at a molar ratio of the—NCO group to the—OH group of 2. The elastic prepolymer may be a compound of the following formula:

$$\mathrm{OCN{-}R{\left(NH\overset{\overset{\displaystyle O}{\|}}{C}O{-}A{-}O\overset{\overset{\displaystyle O}{\|}}{C}NH\right)}_n RNCO}$$

wherein n is greater than 1, which is prepared by reacting the above-mentioned isocyanate compound with the above-mentioned polyester or polyether at a molar ratio of the—NCO group to the OH group of less than 2. The prepolymer can be converted into elastic polymer by linking the prepolymer molecules with a chain-linking agent and/or by cross-linking the prepolymer molecules with a cross-linking agent. The chain-linking agent and the cross-linking agent may be selected from water, ethylene glycol, diamine compounds, aminoalcohol, glycerin, or hexanetriol.

The elastic prepolymer may be applied in the state of an aqueous emulsion into the substratum fabric in the same manner as that mentioned hereinbefore. The substratum fabric impregnated with the elastic prepolymer emulsion is dried at a temperature of from 50° to 150° C. and then, cured at a temperature of from 70° to 180° C.

The impregnation of the substratum fabric with the elastic polymer can be effected by another process which comprises:

first, impregnating the substratum fabric with an organic liquid which is compatible with an organic solvent which is capable of dissolving the elastic polymer but not capable of dissolving the extremely fine acrylic polymer fibers or filaments;

second, impregnating the first impregnated fabric with a solution of the elastic polymer in the organic solvent, and;

then, immersing the second impregnated fabric into a liquid which is not capable of dissolving both the elastic polymer and the extremely fine acrylic polymer fibers or filaments to cause the elastic polymer to be coagulated in the fabric.

In the above-mentioned impregnating process, the organic liquid to be first impregnated is selected from the group consisting of methyl alcohol, ethyl alcohol, toluene, xylene, benzene, ethyl acetate, n-butyl acetate, propyl acetate, isobutyl acetate, acetone, methylethylketone, cyclohexanone, methylene chloride, trichloroethylene, tetrachloroethylene and mixtures of two or more of the above-mentioned compounds. The above-mentioned compound is compatible with an organic solvent which is capable of dissolving the elastic polymer, but is not capable of dissolving the acrylic polymer. If the organic liquid for the first impregnating operation is not compatible with the organic solvent which is capable of dissolving the elastic polymer, the second impregnating operation will result in an undesirable deposition of a portion of the elastic polymer and the deposited elastic polymer will form a network at the top end portions of the piles. The organic liquid should not be one capable of dissolving the acrylic polymer fibers or filaments in the substratum fabric. If the acrylic polymer fibers or filaments are dissolved, the quality of the substratum fabric or of the resultant impregnated pile fabric will be impaired or modified. The first or second impregnating operation can be carried out by immersing the fabric into a liquid and, then, squeezing the immersed fabric with a pair of nip rollers or a centrifuge, so as to maintain a predetermined amount of liquid in the fabric, or by coating or spraying a predetermined amount of the liquid onto the fabric.

The organic solvent for said elastic polymer is selected from the group consisting of N,N-dimethylformamide, N,N-dimethylacetamide, N,N-dimethylsulfoxide and mixtures of at least two of the above-mentioned compounds. Also, the liquid in which the second impregnated fabric is immersed, is selected from the group consisting of water, methyl alcohol, ethyl alcohol, glycerine, aqueous solutions containing 50% by weight or less of at least one member selected from the group consisting of dimethylformamide, dimethylacetamide and dimethylsulfoxide, and mixtures of two or more of the above-mentioned liquids. In the second impregnating operation, it is preferable that the elastic polymer solution contains 1 to 30%, more preferably, 5 to 10% by weight of the elastic polymer. After the coagulating operation is finished, the impregnated fabric may be washed with water and then dried, preferably at a temperature of 50° to 150° C.

The extremely fine acrylic polymer fiber pile fabric of the present invention has a good chalk mark-forming property due to a high density of the piles in the pile layer. Also, in the pile fabric of the present invention, the structure of the substratum fabric can be completely hidden from view by the naked eye by the pile layer. With the pile fabric of the present invention, the substratum fabric can be dyed a brilliant and deep color before or after the raising operation or the impregnating operation with the elastic polymer. The impregnating liquid may contain additives, for example, coloring matter and anti-foaming agent. Also, after the impregnating operation is finished, the resultant pile fabric may be brushed, sheared or treated with an oiling agent or anti-static agent. The extremely fine acrylic polymer fiber pile fabric of the present invention has a natural suede or nubuck-like appearance and feel.

The features and advantages of the present invention are further illustrated by the examples set forth below, which are not intended to limit the scope of the present invention in any way.

In the Examples, the amount of the root protions of the piles embedded with the elastic polymer was determined as follows.

Before impregnating a raised substratum fabric with an elastic polymer, a portion of the raised substratum fabric having a predetermined area was cut off. The pile layer of the substratum fabric was sheared, and the total weight of the sheared piles was determined and referred to as $W_1$. After impregnating the raised substratum fabric with the elastic polymer, a portion of the impregnated fabric having the same area as the above-mentioned predetermined area was cut off. The top portions of the piles not embedded in the elastic polymer were sheared and the total weight of the sheared piles was determined and referred to as $W_2$.

The amount A in percent of the piles embedded in the elastic polymer was calculated in accordance with the following equation.

$$A(\%) = \frac{W_1 - W_2}{W_1} \times 100$$

EXAMPLE 1

An acrylic polymer was provided by suspension-copolymerizing 92.3% by weight of acrylonitrile, 7.0% by weight of methyl acrylate and 0.7% by weight of sodium methallylsulfonate in water. The resultant polymer having a polymerization degree of about 1000 was dissolved in an aqueous solution containing 70.0% by weight of nitric acid at a temperature of 5° C. to provide a viscous spinning solution containing 14.8% by weight of the acrylic polymer. The spinning solution was extruded into a coagulating bath consisting of an aqueous solution of 43% by weight of nitric acid at a theoretical extruding speed of 1.89 m/minute, and coagulated while drafting the coagulated filaments at a draft ratio of 3.5. The coagulated filaments were taken up at a speed of 6.6 m/minute. The filaments were washed with water and heat-drawn in hot water at a temperature of 100° C. at a draw ratio of 9.8. The drawn filaments were dried at a temperature of 90° C. and then heat-relaxed in a steam atmosphere at a temperature of 105° C. The resultant extremely fine acrylic polymer filaments were cut to provide staple fibers having a length of from 30 to 50 mm each. The staple fibers each had a denier of 0.19 and a porosity of 80%. The mass of staple fibers had a wool-like slippery touch and a proper softness. The microscopic view, at a magnification of 8000×, of the peripheral surface of the above-obtained extremely fine acrylic polymer fiber is shown in FIG. 1. In FIG. 1, the peripheral surface of the fiber is provided with numerous amorphous scale-shaped protuberances having an average length of 1.5 microns and an average height of 0.1 microns.

The staple fibers were converted into two-folded yarns each composed of two spun yarns of a metric count of 50. A four-harness satin fabric having a warp density of 130 yarns/25.4 mm and a weft density of 100 yarns/25.4 mm was produced by using the above two-folded acrylic polymer fiber yarns. The satin fabric had a weight of 180 g/m$^2$. The satin fabric was raised by a conventional card clothing raising machine.

The raised satin substratum fabric was impregnated with 88%, based on the weight of the substratum fabric, of a 20% solution of polyurethane elastomer in a solvent mixture consisting of 80% by weight of N,N-dimethylformamide and 20% by weight of methyl alcohol. The impregnated fabric was immersed in water at a temperature of 25° C. to coagulate the polyurethane elastomer in the substratum fabric. The substratum fabric treated as mentioned above was washed with water, dried with hot air at a temperature of 80° C. and, then, heat-treated in hot air at a temperature of 140° C. for 15 minutes. The resultant pile fabric contained 15% of the polyurethane elastomer based on the entire weight of the raised, impregnated pile fabric. The impregnated fabric was buffed on its pile layer surface with sandpaper. The resultant pile fabric contained 7% of the polyurethane elastomer based on the entire weight of the resultant pile fabric.

As this pile fabric, the root portions of the piles were embedded in an amount of 30% based on the total weight of the piles in the polyurethane elastomer. The pile fabric obtained above had a natural suede-like look and touch.

As one comparison example, the same procedures as those mentioned above for producing the extremely fine acrylic polymer filaments were carried out except that the coagulating bath consisted of an aqueous solution of 41% by weight of nitric acid. The extruded streams of the spinning solution and coagulated acrylic polymer filaments were very frequently broken in the coagulating bath.

As another comparison example, the same procedures as those mentioned in the present example for preparing the extremely fine acrylic polymer filaments were carried out, except that the coagulating aqueous solution contained 44.2% by weight of nitric acid. During the extruding and coagulating operations, the extruded spinning solution streams and coagulated filaments very frequently adhered to each other and were thus broken.

As a further comparison example, the same procedures as those mentioned in the present example for providing the extremely fine acrylic polymer filaments were carried out, except that the theoretical extruding speed was 1.89 m/minute and the draft ratio was 0.9. This low draft ratio allowed the extruded spinning solution streams and coagulating filaments to move freely in the coagulating bath. The streams and filaments frequently adhered to each other and were therefore broken.

As an additional comparison example, the same procedures as those mentioned in the present example were carried out for producing extremely fine acrylic polymer filaments, except that the spinning solution contained 59.4% by weight of nitric acid, the coagulating solution contained 43.5% by weight of nitric acid, and the spinning holes each had a diameter of 0.1 mm.

During the extruding and coagulating operations, the spinning solution streams and coagulated filaments were frequently found to be adhered together, and, therefore, the spinning process could not be industrially continued for a long period of time.

EXAMPLE 2

Figure 2:
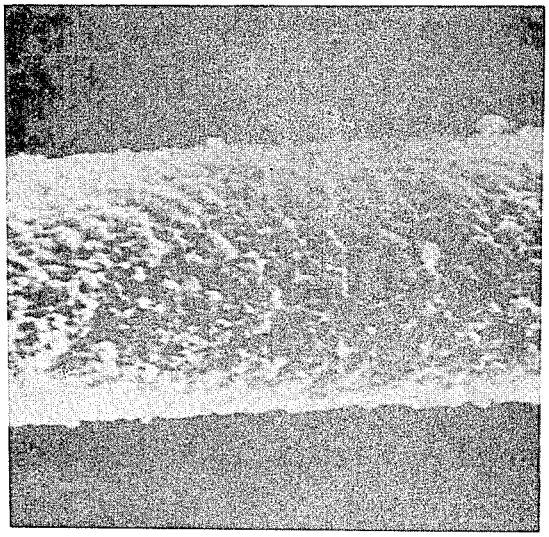
FIG. 2 is a microscopic photograph of another extremely fine acrylic polymer fiber having numerous scale-shaped protuberances formed on the periphery thereof.

The same acrylic polymer as that mentioned in Example 2 was dissolved in a concentration of 15.8% in an aqueous solution of 80% by weight of nitric acid to provide a spinning solution. The spinning solution was extruded into a coagulating solution containing 42.3% by weight of nitric acid through a spinneret having 1000 spinning holes having a diameter of 0.08 mm each at a theoretical extruding speed of 3.1 m/minute, and the resultant coagulated filaments were taken up at a speed of 4.6 m/minute while drafting them at a draft ratio of 1.5. The taken-up filaments were washed with water, and then heat-drawn at a draw ratio of 20.0 in a steam atmosphere. The drawn filaments were simultaneously dried and heat-relaxed at a temperature of 110° C. for 15 minutes. The resultant acrylic polymer filament yarn had a total denier of 300 and was composed of 1000 individual filaments having a porosity of 50%. The microscopic view, at a magnification of 8000×, of the peripheral surface of the above-obtained acrylic polymer filament is shown in FIG. 2. In FIG. 2, numerous amorphous scale-shaped protuberances, having an average length of 0.3 microns and an average height of 0.05 microns are formed on the peripheral surface of the filament.

A five-harness satin fabric having a weight of 200 g/m$^2$ was prepared from the above-obtained acrylic polymer filament yarn. This satin fabric had a warp density of 90 yarns/25.4 mm and a weft density of 60 yarns/25.4 mm.

The fabric was raised by means of a card clothing raising machine.

The raised satin substratum fabric was impregnated in the same manner as that mentioned in Example 1.

The resultant pile fabric contained 12% of the polyurethane elastomer based on the entire weight of the substratum pile fabric, and had a proper softness and a natural suede-like smooth touch.

As a comparison example the same procedures as those mentioned above were carried out, except that an acrylic polymer multifilament yarn of 900 denier/1000 filaments was used. The resultant pile fabric had a relatively high stiffness and a coarse touch.

EXAMPLE 3

A part by mole of methylene-bis (4-phenyl-isocyanate) and a part by mole of 1,4-tolylene diisocyanate were dissolved in a solution of a part by mole of polyester of propylene glycol, having a molecular weight of 2000, a hydroxyl value of 45 and an acid value of 0.5, with adipic acid in toluene. The solution was heated at a temperature of 100° C. for three hours to allow the above-mentioned reactants to be reacted with each other. Thereafter, the same propylene glycol as that mentioned above was added dropwise in the same amount by mole as that of the resultant product to the reaction mixture over a period of one hour. The resultant reaction mixture was a solution containing 30% by weight of the resultant prepolymer.

The solution was mixed with diethyl malonate malate as a masking agent for the prepolymer in a molar ratio of said diethyl malonate to said resultant prepolymer of 2.2:1, and the mixture was heated at a temperature of 100° C. for one hour. The resultant solution was concentrated to provide a solution containing 50% by weight of the prepolymer, and the concentrated solution was emulsified in water containing an emulsifying agent and adjusted to a pH of 3.0 by adding a hydrochloric acid aqueous solution.

An impregnating emulsion was prepared by mixing 30 parts by weight of the above-mentioned emulsion with 70 parts by weight of water and by adjusting the pH of the emulsion to a value of 4 to 6 by adding sodium bicarbonate.

The same raised substratum fabric as that mentioned in Example 1 was immersed in the above-prepared emulsion and squeezed by a pair of nip rollers so as to allow 100% based on the weight of the fabric, of the emulsion to remain in the fabric. The impregnated fabric was dried at a temperature of 120° C. for one hour and cured at a temperature of 150° C. for 5 minutes to convert the prepolymer into an elastic polymer.

The resultant raised, impregnated fabric contained 4.2% the elastic polymer based on the entire weight of the resultant fabric.

The fabric was buffed on the raised surface with sandpaper. The root portions of the piles, in an amount of 15% based on the total weight of the piles, were embedded in the elastic polymer. The resultant pile fabric had a natural suede-like appearance and touch.

EXAMPLE 4

The same raised substratum fabric as that described in Example 2 was first impregnated with methylethylketone in an amount of 100%, based on the weight of the fabric. The first impregnated fabric was then impregnated with a solution of 5% by weight of a polyurethane elastomer in N,N-dimethylformamide. The latter impregnated fabric was immersed in water, so as to cause the polyurethane elastomer to be coagulated and deposited in the substratum fabric. The resultant pile fabric had natural suede-like look, feel and chalk mark-forming property, and contained 13% of the polyurethane, based on the entire weight of the resultant pile fabric. In this pile fabric, the root portions of the piles were embedded, in an amount of 40%, based on the total weight of the piles, in the polyurethane elastomer.

The pile fabric prepared as mentioned above was dyed with a cation dye. A natural suede-like pile fabric having a brilliant deep color was obtained.

I claim:

1. An extremely fine acrylic polymer fiber pile fabric comprising a substratum fabric impregnated with an elastic polymer and having at least one pile layer formed by raising at least one surface of said fabric, characterized in that said piles consist essentially of extremely fine independent acrylic polymer fibers, each of which has a denier of 0.8 or less and is provided with a number of amorphous scale-shaped protuberances formed on the peripheral surface thereof, and which has been produced by a wet spinning method from an acrylic polymer containing at least 80% by weight of acrylonitrile.

2. A fabric as claimed in claim 1, wherein the denier of said extremely fine acrylic polymer fibers is 0.4 or less.

3. A fabric as claimed in claim 2, wherein the denier of said extremely fine acrylic polymer fibers is 0.2 or less.

4. A fabric as claimed in claim 1, wherein said substratum fabric is a woven fabric.

5. A fabric as claimed in claim 4, wherein said woven substratum fabric is prepared by heating, in a heating medium at a temperature of 60° C. or more, a woven fabric composed of wefts, each consisting of at least one spun yarn or multifilament yarn which consists of extremely fine acrylic polymer fibers or filaments having a denier of 0.8 or less, and warps, each consisting of at least one spun yarn or multifilament yarn and having a shrinkage the same as or larger than that of said weft-forming yarn in a heating medium having a temperature of 60° C. or more; and raising at least one surface of the heated fabric to form at least one pile layer composed essentially of the extremely fine acrylic polymer fibers.

6. A fabric as claimed in claim 5, wherein said spun yarn or multifilament yarn for said warp is composed of acrylic polymer, polyester, polyamide, cotton, regenerated cellulose, insolubilized polyvinyl alcohol or modacrylic polymer fibers or filaments, wool or a mixture of two or more of said above-mentioned fibers or filaments.

7. A fabric as claimed in claim 5, wherein said extremely fine acrylic polymer fibers or filaments for said wefts, have a shrinkage of not more than 40% in the heating medium at a temperature of 60° C. or more.

8. A fabric as claimed in claim 5, wherein said weft spun yarn or multifilament yarns contain 70% by weight or more of said extremely fine acrylic polymer fibers or filaments.

9. A fabric as claimed in claim 1, wherein said substratum fabric is a knitted fabric consisting essentially of extremely fine acrylic polymer fibers or filaments having a denier of 0.8 or less.

10. A fabric as claimed in claim 1, wherein said substratum fabric is a non-woven fabric consisting essentially of extremely fine acrylic polymer fibers or filaments having a denier of 0.8 or less.

11. A fabric as claimed in claim 1, wherein the root portions of said piles are embedded with said impregnated elastic polymer.

12. A fabric as claimed in claim 11, wherein said embedded root portions of said piles are in an amount of 5 to 80% based on the total weight of said piles.

13. A fabric as claimed in claim 1, wherein said elastic polymer is selected from the group consisting of polyurethanes, polyamides, polyamino acids, polyvinyl chloride, ethylene-vinyl acetate copolymers, styrene-butadiene copolymers, butadiene-acrylonitrile copolymers, polymeric materials consisting essentially of at least one acrylic ester, and mixtures of two or more of the above-mentioned polymers.

14. A fabric as claimed in claim 13, wherein said polyurethane is selected from the group consisting of polyether type polyurethanes, polyester type polyurethanes, polyether-polyester block copolymer type polyurethanes and mixtures of two or more of the above-mentioned polymers.

15. A fabric as claimed in claim 1, wherein the amount of said impregnated elastic polymer is in a range of from 1 to 30% based on the entire weight of said raised, impregnated pile fabric.

16. A fabric as claimed in claim 1, wherein said scale-shaped protuberances have an average height of 0.2 microns or less.

17. A fabric as claimed in claim 1, wherein said scale-shaped protuberances have an average length of 3 microns or less.

18. A fabric as claimed in claim 1, wherein said extremely fine acrylic polymer fiber or filament has a porosity of 20% or more.

19. A fabric as claimed in claim 1, wherein said extremely fine acrylic polymer fiber or filament being provided with said scale-shaped protuberances, is one which has been provided by the process comprising:

dissolving a fiber-forming acrylic polymer in an aqueous solution of 60% by weight or more of nitric acid;

extruding the resultant aqueous nitric acid solution of said acrylic polymer through a spinneret having a plurality of spinning holes into a coagulating bath containing an aqueous solution of 42% by weight or more, but less than 44% by weight, of nitric acid to solidify the extruded streams of said solution of said acrylic polymer in the form of a plurality of filaments;

taking up said solidified acrylic polymer filaments at a take-up speed which is the same as or more than the theoretical extruding speed of said acrylic polymer solution; and, drawing said taken-up acrylic polymer filaments at a predetermined draw ratio, the inside diameters of said spinning holes, the extruding speed of said acrylic polymer solution, said take-up speed and said draw ratio each being fixed at a value which is suitable for obtaining the denier of 0.8 or less of said extremely fine acrylic polymer fiber or filament.

20. A fabric as claimed in claim 19, wherein said aqueous solution of nitric acid for dissolving therein said acrylic polymer has a concentration of nitric acid of from 67 to 90% by weight.

21. A fabric as claimed in claim 19, wherein said aqueous solution of nitric acid for said coagulating bath has a concentration of nitric acid of from 42 to 43.5% by weight.

22. A fabric as claimed in claim 19, wherein said take-up speed of said solidified filaments is 1 to 30 times said extruding speed of said acrylic polymer solution.

23. A fabric as claimed in claim 19, wherein said drawing is carried out at a temperature of from 70° to 200° C.

24. A fabric as claimed in claim 19, wherein said drawing is carried out at a draw ratio in a range of from 3 to 25.

25. A fabric as claimed in claim 19, wherein said inside diameter of said spinning holes is in a range of from 0.04 to 0.20 mm, and said theoretical extruding speed is in a range of from 0.4 to 10.0 m/m.

26. A fabric as claimed in claim 19, wherein said drawn filaments are heat set at a temperature of from 70° to 200° C.

27. A fabric as claimed in claim 19, wherein said aqueous nitric acid solution to be extruded contains 13.5 to 17.5% by weight of said acrylic polymer.

28. A process for producing an extremely fine acrylic polymer fiber pile fabric comprising the steps of:

impregnating a substratum fabric containing extremely fine acrylic polymer fibers or filaments, each of which has a denier of 0.8 or less and is provided with a number of amorphous scale-shaped protuberances formed on the peripheral surface thereof, and which has been produced by a wet spinning method from an acrylic polymer containing at least 80% by weight of acrylonitrile, with a solution of said elastic polymer in a solvent mixture which is capable of dissolving said elastic polymer but not dissolving said acrylic polymer fibers or filaments;

immersing said impregnated fabric into a coagulating liquid which is not capable of dissolving both said elastic polymer and said acrylic polymer fibers or filaments, to cause said elastic polymer to be coagulated in said substratum fabric, said solvent mixture consisting of from 50 to 90% by weight of an organic solvent capable of dissolving said elastic polymer and from 10 to 50% by weight of an organic liquid which is compatible with both said organic solvent and said coagulating liquid but which is not capable of dissolving said acrylic polymer fibers or filaments; and raising during at least one stage selected from stages occuring before said impregnating step and after the immersing step, at least one surface of said substratum fabric to form a pile layer thereon.

29. A process as claimed in claim 28, wherein said organic solvent is selected from the group consisting of N,N-dimethylformamide, N,N-dimethylacetamide, N,N-dimethylsulfoxide and mixtures of at least two of the above-mentioned compounds and said organic liquid is selected from the group consisting of acetone, methyl alcohol, ethyl alcohol, methylethylketone, toluene, ethyl acetate, butyl acetate, propyl acetate, isobutyl acetate, cyclohexanone, xylene, trichloroethylene, and mixtures of two or more of the above-mentioned compounds.

30. A process for producing a raised fibrous fabric comprising the steps of:

impregnating a substratum fabric containing extremely fine acrylic polymer fibers or filaments, each of which has a denier of 0.8 or less and is provided with a number of amorphous scale-shaped protuberances formed on the peripheral surface thereof, and which has been produced by a wet spinning method from an acrylic polymer containing at least 80% by weight of acrylonitrile, with an aqueous emulsion of said elastic polymer or its prepolymer;

heat-treating said impregnated fabric at a temperature of from 60° to 180° C. in a gas atmosphere to cause said elastic polymer to be deposited on said substratum fabric; and raising during at least one stage selected from stages occurring before said impregnating step and after said heat-treating step, at least one surface of said substratum fabric to form a pile layer thereon.

31. A process as claimed in claim 30, wherein said aqueous emulsion contains from 1 to 30% by weight of said elastic polymer.

32. A process as claimed in claim 30, wherein said heat-treating step is effected by drying said elastic polymer emulsion-impregnated fabric at a temperature of from 60° to 110° C. and, thereafter, curing said dried elastic polymer impregnated fabric at a temperature of from 70° to 180° C.

33. A process for producing a raised fibrous fabric comprising the steps of:

first impregnating a substratum fabric containing extremely fine acrylic polymer fibers or filaments, each of which has a denier of 0.8 or less and is provided with a number of protuberances formed on the peripheral surface thereof, and which has been produced by a wet spinning method from an acrylic polymer containing at least 80% by weight of acrylonitrile, with an organic liquid which is compatible with an organic solvent which is capable of dissolving an elastic polymer but not capable of dissolving said extremely fine acrylic polymer fibers or filaments;

second, impregnating said first impregnated fabric with a solution of an elastic polymer in an organic solvent;

immersing said second impregnated fabric into a liquid which is not capable of dissolving both said elastic polymer and said extremely fine acrylic polymer fibers or filaments to cause said elastic polymer to be coagulated in said raised fabric; and raising, during at least one stage selected from stages occurring before said first impregnating step and after said immersing step at least one surface of said substratum fabric to form a pile layer thereon.

34. A process as claimed in claim 33, wherein said organic solvent to be impregnated first is selected from the group consisting of methyl alcohol or ethyl alcohol, toluene, xylene, benzene, ethyl acetate, n-butyl acetate, propyl acetate, isobutyl acetate, acetone, methylethylketone, cyclohexanone, methylene chloride, trichloroethylene, tetrachloroethylene and mixtures of two or more of the above-mentioned compounds.

35. A process as claimed in claim 33, wherein said organic solvent for said elastic polymer is selected from the group consisting of N,N-dimethylformamide, N,N-dimethylacetamide, N,N-dimethylsulfoxide and mixtures of at least two of the above-mentioned compounds.

36. A process as claimed in claim 33, wherein said liquid in which said second impregnated fabric is immersed, is selected from the group consisting of water, methyl alcohol, ethyl alcohol, glycerine, aqueous solutions containing 50% by weight or less of at least one member selected from the group consisting of dimethylformamide, dimethylacetamide and dimethylsulfoxide, and mixtures of two or more of the above-mentioned liquid.

37. A process as claimed in claim 33, wherein said elastic polymer solution contains 1 to 30% by weight of said elastic polymer.

* * * * *

UNITED STATES PATENT AND TRADEMARK OFFICE

CERTIFICATE OF CORRECTION

PATENT NO. : 4,298,644

DATED : November 3, 1981

INVENTOR(S) : Kunitoshi Shimizu

It is certified that error appears in the above—identified patent and that said Letters Patent is hereby corrected as shown below:

Column 2, line 54, delete "poor" and insert --proper--.

Signed and Sealed this

*Eighteenth* Day of *May 1982*

[SEAL]

*Attest:*

GERALD J. MOSSINGHOFF

*Attesting Officer*

*Commissioner of Patents and Trademarks*